United States Patent [19]

Yamada

[11] 3,989,584

[45] Nov. 2, 1976

[54] LABEL PICK-UP MECHANISM

[75] Inventor: Masuho Yamada, Toyoake, Japan

[73] Assignee: Mitsubishi Jukogyo Kabushiki Kaisha, Tokyo, Japan

[22] Filed: Apr. 3, 1975

[21] Appl. No.: 564,831

[30] Foreign Application Priority Data

Apr. 11, 1974 Japan ..... 49-40703

[52] U.S. Cl. ..... 156/571

[51] Int. Cl.[2] ..... B65C 9/08

[58] Field of Search ..... 156/570–572

[56] References Cited

UNITED STATES PATENTS

| | | | |
|---|---|---|---|
| 3,450,591 | 6/1969 | Zordrow | 156/571 |
| 3,736,213 | 5/1973 | Jorss et al. | 156/570 |
| 3,869,331 | 3/1975 | Saso | 156/571 |

*Primary Examiner*—Douglas J. Drummond
*Attorney, Agent, or Firm*—Cushman, Darby & Cushman

[57] ABSTRACT

An improved label pick-up mechanism to be used in a label applying machine is described herein. The label pick-up mechanism comprises a rotor adapted to be rotationally driven in one direction, a pair of cam members positioned respectively above and under the rotor, a label magazine disposed outside of the circumference of said rotor and provided with a label pick-up opening at its inner end, a plurality of pickers pivotably supported by said rotor in a rockable manner, and means for operating said pickers. The picker operating means is adapted to operate each said picker in such manner that when said picker comes to the position where said label magazine is disposed the picker is struck against a surface of a label waiting at the label pick-up opening at right angles thereto, then said picker is caused to roll along the surface of the label, and after the label has been peeled off the label magazine the picker is caused to retract from the label pick-up opening at right angles thereto, all said operations being achieved under the control of said pair of cam members.

1 Claim, 8 Drawing Figures

Fig. 1
PRIOR ART
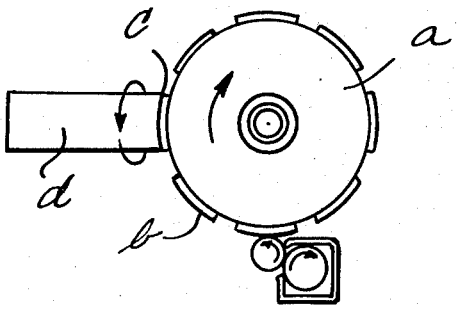
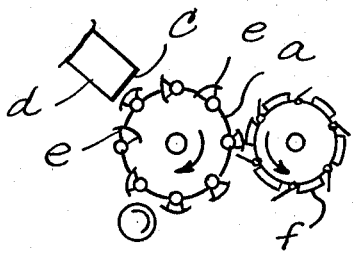
Fig. 2
PRIOR ART
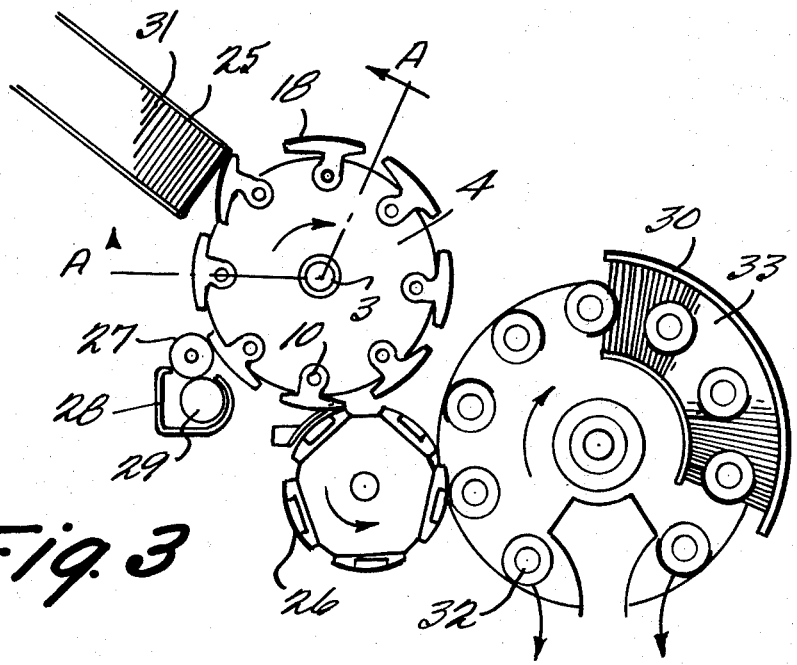
Fig. 3

Fig. 6
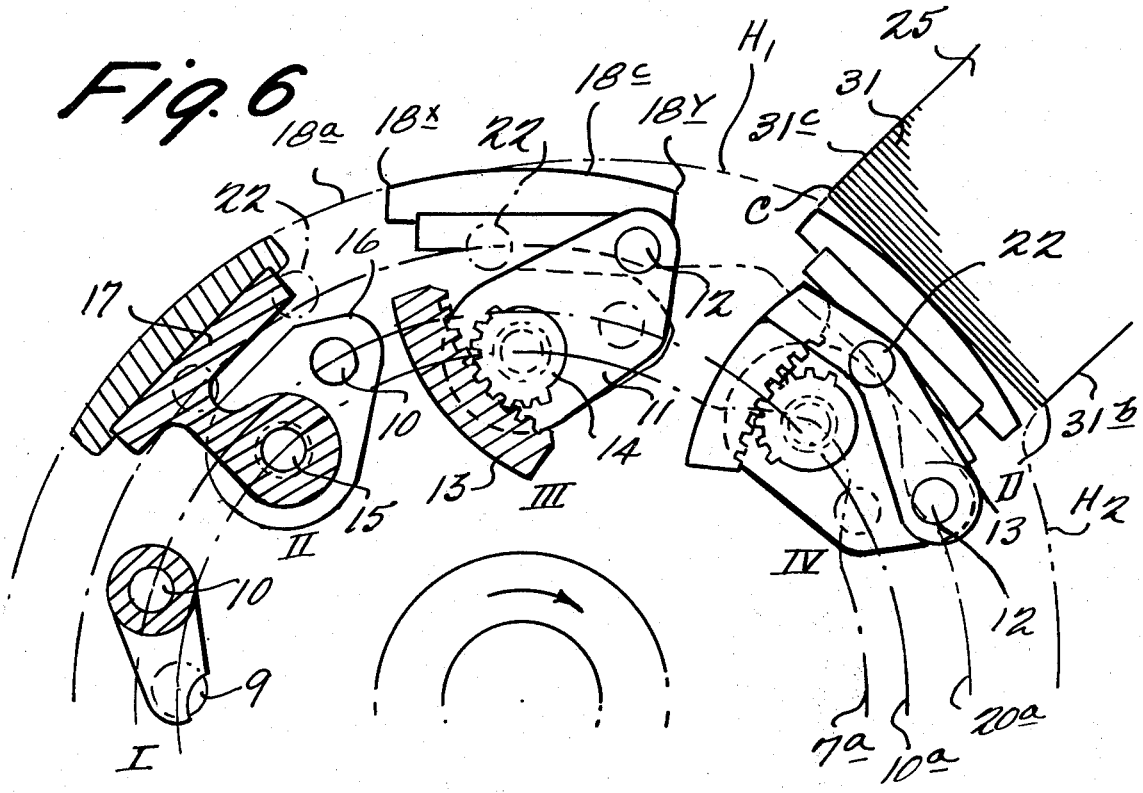
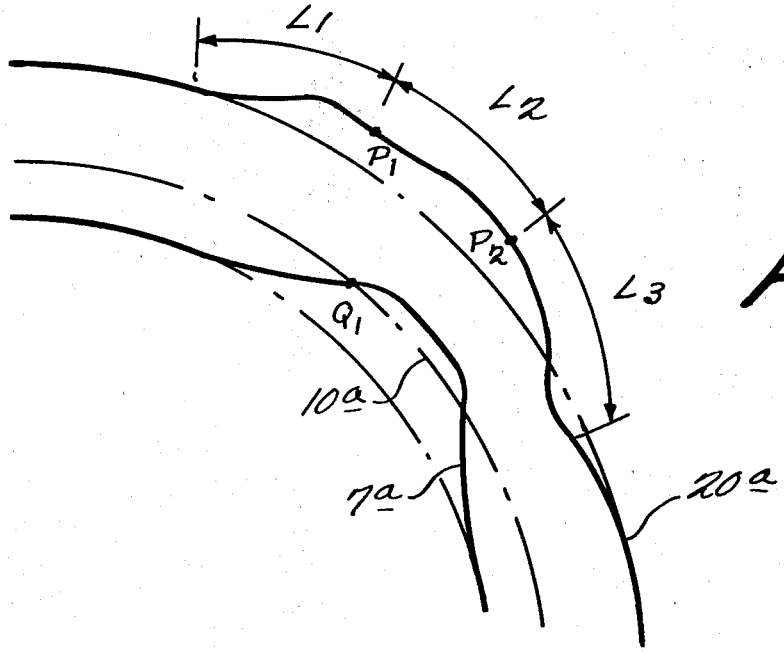
Fig. 7

LABEL PICK-UP MECHANISM

The present invention relates to improvements in a label pick-up mechanism to be used in a label applying machine for sticking labels on bottles, cans, barrels, etc.

Heretofore, various types of label pick-up mechanisms employing pasted pickers for use in a label applying machine have been known. However, so long as the inventor of this invention is aware of, these label pick-up mechanisms in the prior art had at least any one of the disadvantages that a high speed operation of the label pick-up mechanism was limited owing to an inertia of a label magazine, that an operation of replenishing labels involved a difficult problem, that since a perfect rolling operation of a pasted picker on a label surface cannot be expected in the beginning and at the end of the engagement therebetween, deviation, creasing or mispeeling of labels was resulted if the mechanism was applied to labels having an insufficient rigidity, and that because of a too small radius of curvature of a picker a failure in pick-up of a label was resulted if the rigidity of the label was too high.

Therefore, it is a principal object of the present invention to provide an improved label pick-up mechanism employing pasted pickers which can achieve a perfect label pick-up operation even at an increased operation speed without being appreciably affected by a rigidity of labels.

According to one feature of the present invention, there is provided a label pick-up mechanism comprising a rotor adapted to be rotationally driven in one direction, a pair of cam members positioned respectively above and under the rotor, a label magazine disposed outside of the circumference of said rotor and provided with a label pick-up opening at its inner end, a plurality of pickers pivotally supported by said rotor in a rockable manner, and means for operating said pickers in such manner that when each said picker comes to the position where said label magazine is disposed the picker is struck against a surface of a label waiting at the label pick-up opening at right angles thereto, then said picker is caused to roll along the surface of a label waiting at the label pick-up opening at right angles thereto, then said picker is caused to roll along the surface of the label, after the label has been peeled off the label magazine the picker is caused to retract from the label pick-up opening at right angles thereto, all said operations being achieved under the control of said pair of cam members.

Figure 4:
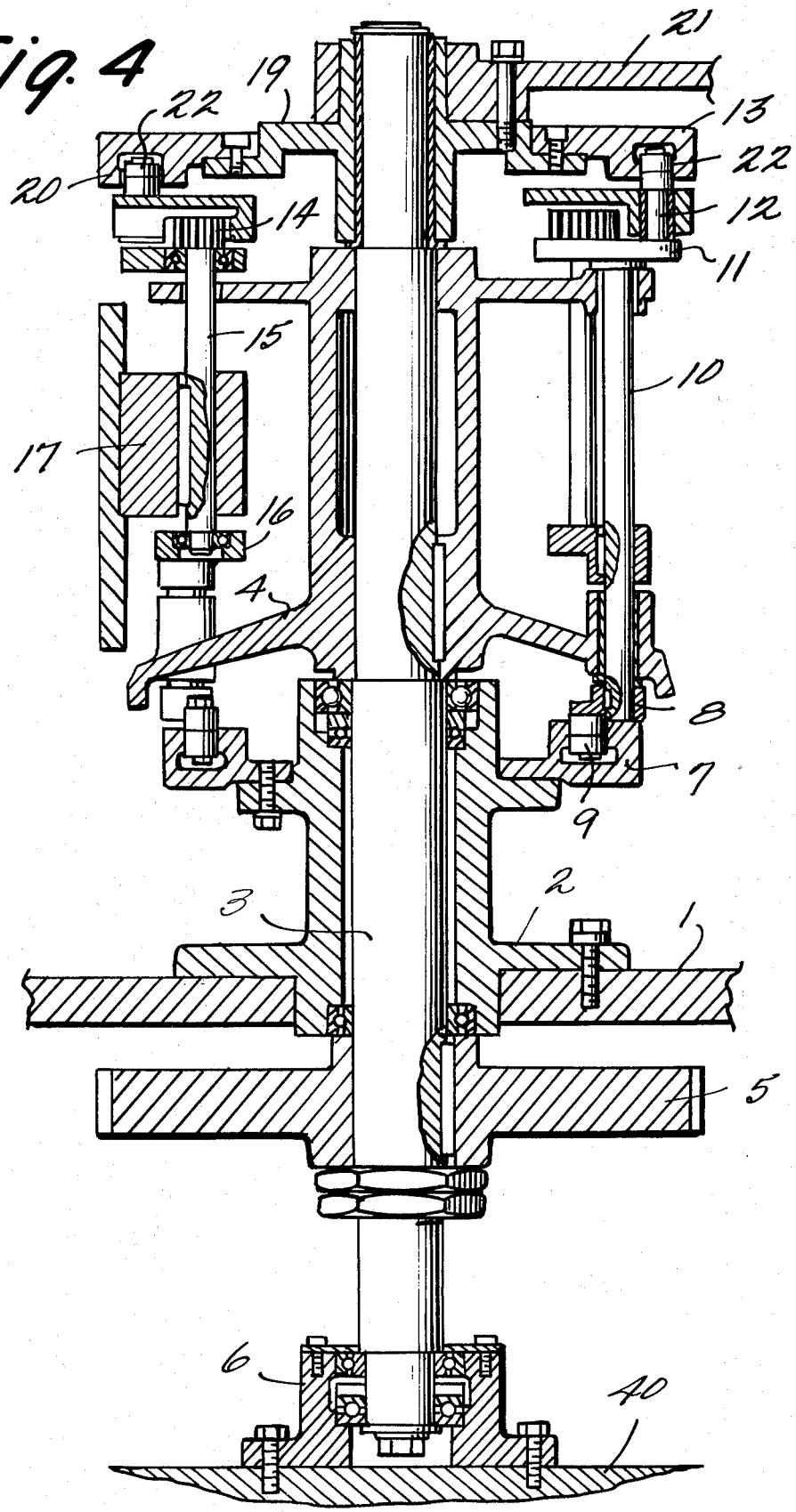
Figure 5:
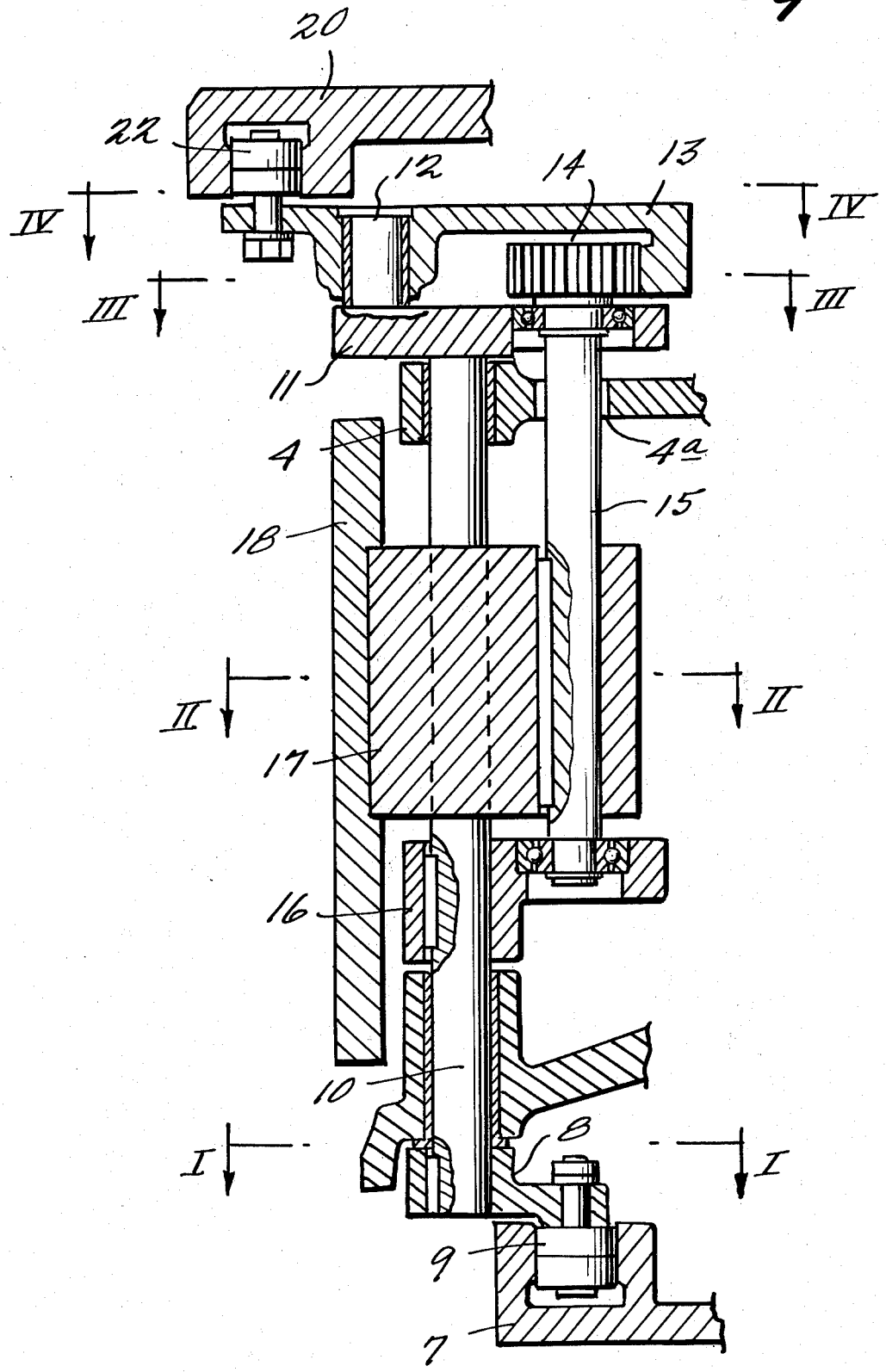
Figure 5A:
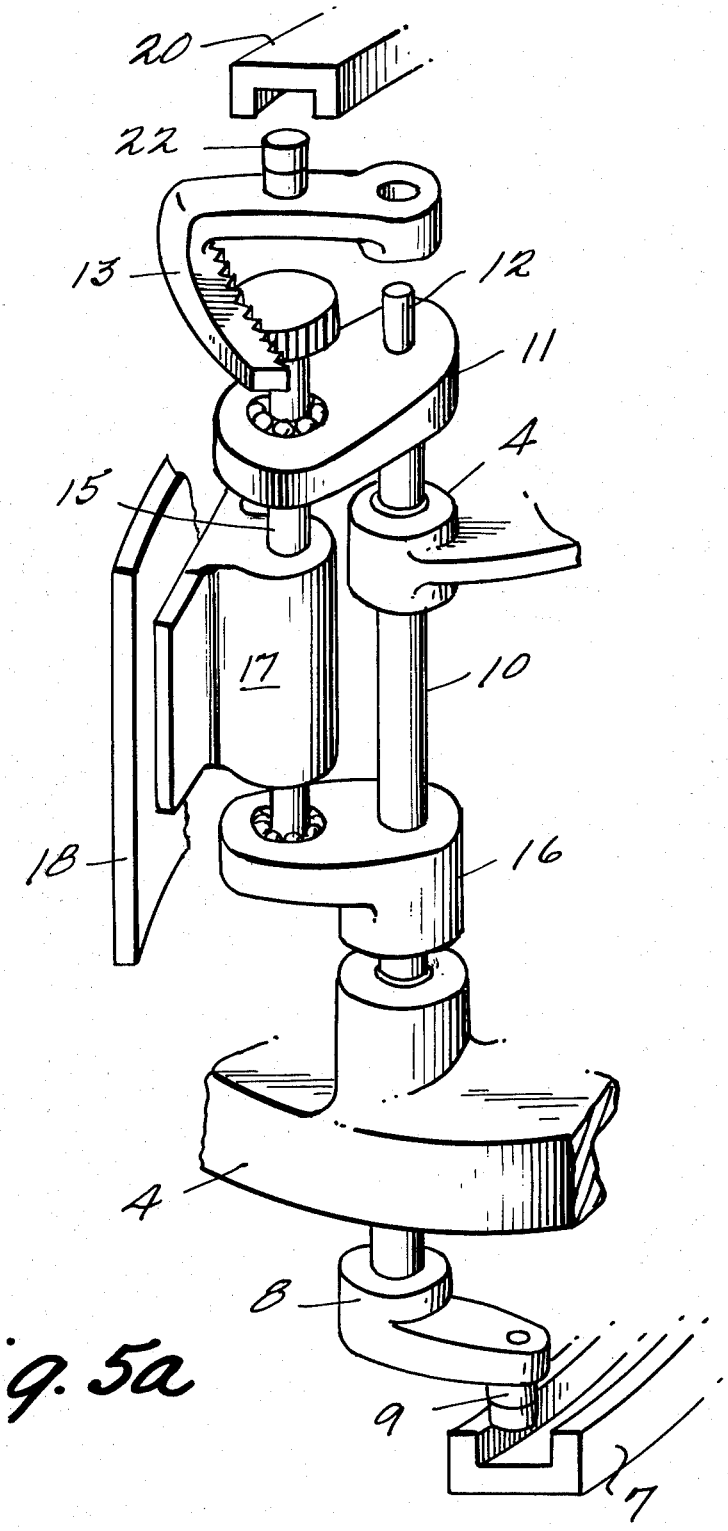

Above-mentioned and other features and objects of this invention will become more apparent by reference to the following description taken in conjunction with the accompanying drawings, in which:

FIGS. 1 and 2 are schematic plan views of label pick-up mechanisms in the prior art, FIG. 3 is a plan view showing an arrangement of a label applying machine incorporating one preferred embodiment of the present invention, FIG. 4 is a vertical cross-section view taken along line A—A in FIG. 3, FIG. 5 is a detailed partial cross-section view of a label pick-up mechanism according to one preferred embodiment of the present invention, FIG. 5*a* is a perspective view of the part of the label pick-up mechanism shown in FIG. 5 for more clearly illustrating the relative arrangement of the respective members, FIG. 6 is a cross-section view of a part of the label pick-up mechanism according to one preferred embodiment of the present invention, in which label pickers and their associated mechanisms are shown at I, II, III and IV in sections taken along lines I—I, II—II, III—III and IV—IV, respectively, in FIG. 5, and FIG. 7 is a diagram showing a phase relationship between two cam profiles used in the illustrated embodiment of the invention.

Before going into a detailed description of the present invention, two representative examples of the label pick-up mechanisms will be described with reference to FIGS. 1 and 2, respectively.

In a first example of the label pick-up mechanism employing pasted pickers to be used for a label applying machine in the prior art as shown in FIG. 1, reference character *a* designates a rotor drum, reference character *b* designates pickers integrally mounted on the rotor drum *a*, and reference character *d* designates a label magazine.

While the rotor drum *a* is rotating in the direction indicated by an arrow, each picker *b* on the cylindrical surface of the rotor drum *a* is pasted on its outer surface by means of a pasting device shown at *e*. The label magazine *d* in which a large number of labels are accommodated in a stack, is moved in the plane of the sheet along a substantially elliptic locus as represented by an arrowed closed loop by means of an appropriate drive mechanism synchronized in phase with the rotation of the pickers *b*, so that the foremost label surface in the label magazine *d* may be struck against the outer surface of each picker *b* at right angles thereto in their relative motion, then it is moved laterally with the same tangential velocity as the picker surface without any slip therebetween, and finally it is retracted from the picker surface at right angles thereto in their relative motion. In FIG. 1, the label magazine *d* is shown at its rightmost position where the foremost label *c* in the label magazine *d* is aligned with one picket *b* and is pressed thereto. In this case, since the tangential velocities of the foremost surface of the label magazine *d* and the picker *b* are kept equal to each other while they are contacting, the picker *b* and the foremost label that is integrally pasted to said picker would make a relative rolling movement on the surface of the second label in the label magazine *d*, and consequently, deviation, creasing or mispeeling of labels would scarcely occur. However, this label pick-up mechanism requires to reciprocate the massive label magazine *d* periodically in its longitudinal and lateral directions, and therefore, a high speed operation of this mechanism is naturally limited by the inertia of the label magazine *d*. Also, this mechanism involves a difficult problem in connection to replenishment of labels during its continuous operation, because the labels must be replenished into the continuously moving label magazine.

In a second example of the label pick-up mechanism in the prior art as shown in FIG. 2, while a rotor *a* is rotating in the clockwise direction, a plurality of pickets *e* having a section of cylindrical surface which are pivotably mounted along the outer circumference of said rotor *a*, rotate in the anticlockwise direction in synchronism with said rotor *a* so that when the pivot of each picker *e* approaches one end of the foremost label *c* in a label magazine *d*, the cylindrical surface section of the picker *e* may be pressed against the pile of labels in the magazine with one edge of the cylindrical surface section aligned with the nearest edge of the foremost label *c*, and then the cylindrical surface section of the picker *e* rolls along the surface of the label *c*. Since the cylindrical surface section of the rotating picker *b* is pasted by pasting means *b* before it approaches to the label magazine *d*, when the cylindrical surface section of the picker *e* makes contact with the foremost label *c* in the label magazine *d* the foremost label is peeled off by the pasted cylindrical surface while the cylindrical surface section and the foremost label integrally sticked thereto are rolling along the surface of the second label in the label magazine *d*. After the picker *e* has passed over the label magazine *d* as picking up the foremost label *c*, the label picked up by each picker *e* is delivered to a transfer turret *f*.

In the above-described operation, in order to assure an adhesive force between the label surface *c* and the pasted cylindrical surface section of the picker *e*, a certain degree of contact pressure therebetween is necessitated. However, the cylindrical surface section of the picker *e* is pressed against the stack of labels in the label magazine *d* with a relatively small pressure at the opposite edges of the label surface *c*, although it is pressed with a relatively large pressure at the center of the label surface *c* where the picker *e* is somewhat sunk in the label stack in the label magazine *d* because of the circular locus of the pivot of the picker *e*. Thus if the rotation of the picker *e* and that of the rotor *a* are synchronized in such manner that each picker *e* can achieve a perfect rolling movement along the center portion of the foremost label surface *c*, then in the beginning and at the end of the rolling movement, that is, at the opposite edges of the label surface *c*, a perfect rolling movement without any slip can not be expected. Therefore, in case that this label pick-up mechanism is applied to labels having an insufficient rigidity, then deviation, creasing or failure in peeling of the label would be resulted. On the other hand, in case that this label pick-up mechanism is applied to labels having a too high rigidity, then failure in pick-up of the label would be resulted because of the too small diameter of the pickers.

The present invention has been worked out for the purpose of overcoming every disadvantage of the label pick-up mechanisms in the prior art as described above, and according to the present invention, in order to assure stable adhesion of a label in a label stack stationally stored in a label magazine onto a cylindrical picker surface, the picker is struck against the label surface at right angles thereto, then the label is peeled off by the picker while the latter is caused to roll along the surface of the label stack, and at the trailing edge of the surface of the label stack the picker is retracted from the stack surface at right angles thereto.

Now the present invention will be described in detail in connection to its preferred embodiment with reference to FIGS. 3 through 7 of the drawings. In these figures, a drive gear 5 is driven by a driving power source not shown, and thereby a shaft 3 and a rotor drum 4 integrally mounted on the drive gear 5 are rotated in the direction indicated by an arrow. Reference numeral 28 designates a paste box, numeral 29 designates a paste feed roll and numeral 27 designates a pasting roll, which makes contact with each picker 18 provided on the circumference of the rotor drum 4 while rolling thereon and thereby pastes the surface of the picker 18. The pasted picker 18 picks up a label 31 from a label magazine 25 and transfers it to a label gripper 26. The label gripper 26 further transfers the label to each bottle 32 on a rotary table 30. Reference numeral 30 designates a label applying brush for finishing.

On a base member 1 is fixedly mounted a bearing member 2 provided with ball bearings, and a lower cam 7 is fixedly mounted on the bearing member 2. The shaft 3 is supported by the bearing member 2 and another bearing member 6 provided with ball bearings that is fixedly mounted on a base member 40, so that it can be rotated integrally with the rotor drum 4.

A support member 19 on which an upper cam 20 is fixedly mounted, loosely fits around the shaft 3 and is fixedly mounted on the base member 1 via an arm 21. A lever 11 is mounted integrally with a shaft 10 that is loosely fitted in the rotor drum 4, and thus it is rotatably supported by the rotor drum 4. To the shaft 10 is fixedly secured a lever 16, and the levers 11 and 16 jointly support a shaft 15 and a pinion 14 integrally formed therewith via ball bearings.

Reference numeral 4*a* designates an escape recess provided in the rotor drum 4 for admitting the movement of the shaft 15. Reference numeral 8 designates a cam lever which is fixedly secured to the bottom end of the shaft 10, and a cam follower 9 pivotally mounted on the cam lever 8 engages with the lower cam 7. Reference numeral 11 designates a picker support member which is integrally jointed to the shaft 15 and a picker 18. A shaft 12 is formed integrally with the lever 11 and is loosely fitted in a hole formed at a pivot end of an inner sector gear 13. A cam follower 22 is pivotally mounted on the inner sector gear and engages with the upper cam 20.

In the illustrated embodiment, for convenience of explanation, the axis distances between the shaft 10 and the shaft 15 and between the shaft 10 and the cam follower 9 are selected equal to each other, and in FIG. 5 they are arranged at such relative positions that the cam follower 9 is positioned right under the shaft 15. Also, it is to be noted that though the pinion 14, the lever 11 and the inner sector gear 13 are disposed above the rotor drum 4 in the illustrated embodiment, they could be disposed under the rotor drum 4.

Now the operation of the embodiment of the present invention that is constructed as described above, will be explained with reference to FIGS. 6 and 7.

FIG. 7 is a diagram showing a phase relationship between two cam profiles 7*a* and 20*a* formed on the cams 7 and 20, respectively, and for convenience of explanation they are divided into three stages $L_1$, $L_2$ and $L_3$. In this figure, thick solid lines 7*a* and 20*a* show the cam profiles, that is, the loci of the cam followers 9 and 22, respectively, as viewed from the above, and a thin solid line 10*a* shows a locus of the shaft 10. At positions I, II and III in FIG. 6, the cam followers 9 and 22 are on the basis circles of the cam profiles 7*a* and 20*a*.

When a picker assembly mounted on the rotor drum 4 is rotated further from the position III in FIG. 6 in the direction indicated by an arrow, the cam follower 22 goes from the basic circle of the cam profile 20*a* into its lift stroke. In the stage $L_1$, the inner sector gear 13 is rotated in the clockwise direction about the shaft 12, so that the pinion 14 rotates in the clockwise direction and thereby the picker 18 is moved via the shaft 15 and the picker support member 17 in such manner that a point 18*x* on a picker surface 18*c* is projected outside of a circumference 18*a* and a point 18*y* on the picker surface 18*c* is retracted inside of the circumference 18*a* as shown in FIG. 6, and then the edge point 18*x* of the picker surface 18*c* moves along a circular locus $H_1$ until it reaches an extension of an edge line 31*c* of the label stack 31 stored within a label magazine 25, when the cam follower 22 comes to a point P on the cam profile 20*a* . From this moment, the picker 18 is subjected to rotational movements about the shaft 15 and about the shaft 3 in the clockwise direction as well as another rotational movement about the shaft 10 in the anticlockwise direction.

More particularly, the clockwise component of the rotational movements consists of that caused by the rotation of the rotor drum 4 and that caused by the slight clockwise rotation of the inner selector gear 13 produced during the movement of the cam follower 22 through the stage $L_2$ of the cam profile 20*a*.

The anticlockwise component of the rotational movements is produced by the fact that in response to the movement of the cam follower 9 through a lift stroke of the cam profile 7*a*, the cam lever 18 and the levers 11 and 16 are rotated about the shaft 10 in the clockwise direction, and consequently, the pinion 14, the shaft 15, the picker support member 17 and the picker 18 are rotated in the anticlockwise direction via the inner sector gear 13.

As an offset effect between these two rotational movements, the movement of the point 18*x* on the picker 18 in the circumferential direction is stopped. This state continues until the cam follower 9 reaches a lifted point Q during its movement along the cam profile 7*a*. On the other hand, the lifting of the cam follower 9 along the cam profile 7*a* means that the picker 18 approaches as a whole to the surface C–D of the foremost label in the label stack 31.

In this way, the point 18*x* on the picker 18 moves along an extension of the label edge line 31*c* until the picker surface 18*c* makes contact with the surface C–D of the label 31 at the point C with such an attitude that the label surface C–D may be tangential to the picker surface 18*c*, and the picker surface 18*c* is further urged against the label surface C–D under a pressure. Thus the picker surface 18*c* has been reliably press contacted to the label 31 at their one edge, and in response to the subsequent rise of the cam follower 9 along the lift stroke portion of the cam profile 7*a*, the picker surface 18*c* rolls along the surface C–D of the label 31. It will be readily seen that during this rolling process, the movement of the rotor drum 4 as well as the movement of the cam follower 22 along the cam profile 20*a* control the movements of the inner sector gear 13 and the pinion 14 and consequently the movement of the picker support member 17 and the picker 18. In this way, when the point 18*y* on the picker 18 has been engaged with the point D on the label 31, the cam followers 9 and 22 enter the lowering strokes of the cam profiles 7*a* and 20*a*, respectively, and the cam levers 8 and the levers 11 and 16 are rotated in the anticlockwise direction, so that the pinion 14 tends to rotate in the clockwise direction. As a result, the movements of the inner sector gear 13 and the pinion 14 are offset with each other, so that the point 18*y* on the picker 18 is separated from the surface C–D of the label 31 as retained on an extension of an edge line 31*b* of the label stack 31 while the cam follower 9 is lowering along the cam profile 7*a* from its lifted portion, and thereby the picker 18 can pick up the foremost label 31 in a reliable manner. In the subsequent operation, the picker surface 18*c* is restored to its home position located along a circumference 18*a*, while the point 18*y* on the picker 18 is moving along a locus $H_2$.

As described above, according to the present invention, since a picker can be controlled in operation in such manner that the picker is struck against a stationary label stack at one end at right angles to the label surface under an accurately alined condition, then the picker is rolled along the label surface without any slip in a reliable manner, and the picker is removed from the label surface at the other end at right angles thereto, deviation and/or creasing of a label would not occur at all upon pick-up of the label. In addition, since the radius of curvature of the picker surface (that is equal to the radius of the circular locus of the revolution of the pickers about the axis of the rotor drum) is sufficiently large, it is possible to pick up labels made of either thick sheets or thin sheets without being affected by the rigidity of the label. Furthermore, the picker interacts with a pasting roller under a relatively rolling condition without any slip, so that the pasting to the picker surface and thus to the label surface can be achieved evenly and reliably.

As fully described above in connection to one preferred embodiment, the label pick-up mechanism according to the present invention is characterized by the fact that said mechanism comprises a rotor adapted to be rotationally driven in one direction, a pair of cam members positioned respectively above and under the rotor, a label magazine disposed outside of the circumference of said rotor and provided with a label pick-up opening at its inner end, a plurality of pickers pivotally supported by said rotor in a rockable manner, and means for operating said picker in such manner that when each said picker comes to the position where said label magazine is disposed the picker is struck against a surface of a label waiting at the label pick-up opening at right angles thereto, then said picker is caused to roll along the surface of the label, and after the label has been peeled off the label magazine the picker is caused to retract from the label pick-up opening at right angles thereto, all said operations being achieved under the control of said pair of cam members. In more particular, when the picker comes to the position where the label magazine is disposed while it is rotated integrally with the rotor, said operating means is actuated as controlled by the cams positioned respectively above and under the rotor, so that the picker is advanced normally to the label surface and is struck against the label at right angles thereto, then the picker rolls along the label surface while peeling the label from the label magazine, and after the label has been peeled off the picker is retracted from the label surface at right angles thereto at the downstream edge of the label along the direction of movement of the picker. Therefore, according to the present invention, since the picker is struck against the label at right angles thereto under an accurately positioned condition, then the picker is caused to roll along the label surface in a reliable manner, and the label is picked up from the label magazine at right angles to the label surface, the present invention provides excellent practical advantages that deviation and/or creasing of labels as is the case with the prior art mechanisms would not occur upon pick-up of the labels, that the labels can be picked up smoothly, and that the subsequent label sticking operation can be achieved in a reliable manner.

Since many changes could be made in the above construction and many apparently widely different embodiments of this invention could be made without departing from the scope thereof, it is intended that all matter contained in the above description or shown in the accompanying drawings shall be interpreted as illustrative and not in a limiting sense.

What is claimed is:

1. A label pick-up mechanism, comprising:

a rotor adapted to be rotationally driven in one angular sense about a generally vertical longitudinal axis of rotation;

an upper cam member above the rotor;

a lower cam member below the rotor;

a label magazine disposed radially outside the circumference of the rotor and provided with a radially inwardly facing label pick-up opening at the radially inner end thereof through which the foremost one of a generally stack of labels is accessable for pick-up;

a plurality of pickers, each having an arcuate, radially outer surface that is generally cylindrically curved about the rotation axis of the rotor, the pickers being arranged in a generally circular series about the circumference of the rotor;

a first generally vertical shaft for each picker;

a picker support member for each picker, the respective picker support members being mounted on the respective first shafts and mounting the respective pickers, thereby disposing the respective pickers beside the respective first shafts;

a plurality of second generally vertical shafts, one for the each picker;

the second shafts being arranged in a circular array supported on said rotor between the rotation axis of the rotor and the circumference of the rotor means journalling the second shafts with respect to the rotor for rotation of each second shaft about its own longitudinal axis;

a first plurality of can followers disposed to follow one of said cam members, there being one first cam follower for each said second shaft;

a first crank-like lever for each first cam follower, each first lever connecting a respective first cam follower to a respective second shaft;

second crank-like lever means mounted on each said second shaft for angular movement therewith about the longitudinal axis of the respective second shaft;

bearing means on each second level means journalling a respective first shaft laterally beside a respective second shaft for angular movement about the longitudinal axis of the respective first shaft;

a plurality of sector gears, one for each picker, each sector gear being pivotally mounted on a respective second shaft for rotation about said respective second shaft;

a second plurality of cam follower disposed to follow the other of said cam members;

each said second cam follower being mounted on a respective one of said sector gears;

a plurality of pinion gears, one mounted on each respective first shaft in meshing relation with a respective sector gear;

a pasting roll with means supplying paste thereon;

means mounting the pasting roll generally vertically for rotation about the longitudinal axis thereof with the surface thereof tangent along a generally vertical line to the circumference of the rotor, at a pasting station disposed angularly upstream of the label magazine, so that as the rotor is rotated about the rotation axis thereof, the pasting roll makes line contact with each picker in succession and rolls a layer of paste thereon from the angularly leading edge to the angularly trailing edge of each picker as each picker passes through the pasting station;

said other cam member being configured to affect each paste-bearing picker as each paste-bearing picker approaches the radially inner end of the label magazine as follows:

the respective second cam follower rotates the respective sector gear angularly upstream of the label magazine, corresponding rotating the corresponding pinion gear, first shaft, picker support member and picker causing the angularly leading edge of the respective picker to lie radially outside the circumference of the rotor and the angularly trailing edge of that picker to lie radially inside the circumference of the rotor;

said one cam member being configured to affect each paste bearing picker as each paste bearing picker approaches and passes the radially inner end of the label magazine as follows:

the respective first cam follower rotates the respective second shaft moving the respective picker radially outwardly in an arc until the angularly leading edge of the respective picker confronts the label pick-up opening at the angularly downstream extreme of the label pick-up opening while proceeding generally radially outwardly of the rotor, substantially normally to said opening;

whereupon the respective other cam member permits the respective pasted picker to rock across the foremost label accessable through said pick-up opening;

said one cam member being further configured to affect each picker as each picker angularly trailing edge rocks into contact with the angularly trailing edge of said foremost label at the radially inner end of the label magazine as follows:

the respective first cam follower rotates the respective second shaft moving the respective picker radially inwardly in an arc withdrawing the angularly trailing edge of the respective picker substantially normally away from the angularly trailing extreme of the label pick-up opening; and said other cam member being further configured to affect each picker upon each picker being withdrawn, as follows:

the respective second cam follower rotates the respective sector gear correspondingly rotating the corresponding pinion gear, first shaft, picker support member and picker causing the picker to resume alignment with the circumference of the rotor.

* * * * *